United States Patent [19]

Mayweather

[11] 4,241,105

[45] Dec. 23, 1980

[54] METHOD OF PLATING THE SURFACE OF A SUBSTRATE

[75] Inventor: William T. Mayweather, Stone Mountain, Ga.

[73] Assignee: Western Electric Company, Inc., New York, N.Y.

[21] Appl. No.: 104,243

[22] Filed: Dec. 17, 1979

[51] Int. Cl.[3] ..... C23C 3/02

[52] U.S. Cl. ..... 427/125; 427/118; 427/229; 427/343; 427/306; 427/404; 427/443.1; 427/436; 106/1.23; 106/1.26; 204/20; 204/38 B; 174/126 C

[58] Field of Search ..... 106/1.26, 1.23; 427/125, 118, 229, 343, 306, 404, 443.1, 436; 204/38 B, 20; 174/120 C, 126 C, 128 BL

[56] References Cited

U.S. PATENT DOCUMENTS

| | | | |
|---|---|---|---|
| 1,472,244 | 10/1923 | Daly | 427/307 |
| 1,890,645 | 12/1932 | Ow-Eschingen | 427/307 |
| 2,010,805 | 8/1935 | Ow-Eschingen | 427/305 |
| 2,511,472 | 6/1950 | Kmecik | 427/307 |
| 2,662,033 | 12/1953 | Andrew | 427/307 |
| 2,847,332 | 8/1958 | Ramadanoff | 427/125 |
| 3,294,578 | 12/1966 | Popeck | 427/437 |
| 3,361,580 | 1/1968 | Schneble et al. | 106/1 |
| 3,425,946 | 2/1969 | Emons | 252/79.1 |
| 3,515,567 | 6/1970 | Kaneyasutani | 147/11 |
| 3,518,067 | 6/1970 | Barth | 427/307 |
| 3,533,828 | 10/1970 | Rowe | 427/307 |
| 3,574,070 | 4/1971 | Sahely | 427/307 |
| 3,607,350 | 9/1971 | Rathsack . | |
| 3,653,953 | 4/1972 | Grant . | |
| 3,658,661 | 4/1972 | Minkler | 204/30 |
| 3,682,786 | 8/1972 | Brown | 204/30 |
| 3,684,534 | 8/1972 | Emerson | 106/1 |
| 3,767,538 | 11/1973 | Politycki | 204/30 |
| 3,847,648 | 11/1974 | Vincent et al. . | |
| 3,983,286 | 9/1976 | Arsac | 428/225 |

FOREIGN PATENT DOCUMENTS

| | | |
|---|---|---|
| 1394164 | 5/1975 | United Kingdom . |
| 1394165 | 5/1975 | United Kingdom . |

*Primary Examiner*—Ralph S. Kendall
*Attorney, Agent, or Firm*—Joel F. Spivak

[57] ABSTRACT

A substrate is plated by a process which includes the steps of catalyzing a substrate by coating its surface with a silver-pyridine complex dissolved in an organic solvent, converting the complex to silver oxide by immersion in a basic solution, and reducing the silver oxide to metallic silver and then electroless plating. When the substrate is copper, the silver oxide is spontaneously converted to a reflective and continuous layer of metallic silver upon immersion in the basic solution. The process as disclosed is used in the manufacture of insulated conductors and cord from nylon filaments.

31 Claims, 2 Drawing Figures

METHOD OF PLATING THE SURFACE OF A SUBSTRATE

TECHNICAL FIELD

The invention relates to the plating of a substrate and more particularly to a process of catalyzing the surface of a substrate with a silver catalyst for electroless plating.

BACKGROUND OF THE INVENTION

Metal plating of a substrate is used in many diverse and ever expanding fields, including the manufacture of printed circuit boards, mirrors, conductors, textiles, and decorative automobile parts. As a consequence there is considerable interests in the development of a variety of metal plating processes designed to meet the needs of the various users. With respect to the manufacture of conductors, it would be particularly desirable to replace twisted tinsel wire which is relatively weak and noisy to manufacture with a metal plated substitute that would be stronger and less noisy to manufacture. However, a major obstacle to metal plating of substrates is the catalyzation of the surface so that it can then support subsequent electroless plating. In response to the problem, several processes to prepare the surface of a substrate for metal plating have been developed. One such approach has been to immerse the substrate in an acidic sensitizing solution which becomes absorbed onto the surface and will reduce the salt of a precious metal catalyst to the corresponding catalytic metal. Thereafter, the sensitized substrate is immersed in a bath containing the salt of a precious metal catalyst. The catalytic metal becomes deposited on the surface of the substrate and provides a plurality of discrete nucleation centers fo subsequent electroless plating of a conductive metal such as copper, chromium, or nickel. A typical sensitizing solution includes stannous chloride, and a reducing agent. The precious metal salt is typically palladium chloride or silver nitrate (U.S. Pat. Nos. 3,518,067; 2,010,805).

One of the problems of the above mentioned method is insufficient adhesion of the electroless plated metal onto the substrate. In order to increase adhesion, several pretreatment steps have been recommended. For example, the surface can be etched with a strong oxidizing solution such as chromic acid/sulfuric acid or with N-N-dimethyl formamide, pyridine and substituted pyridine compounds of alkylene glycol that are soluble at pH 8.7 to 10.7 (U.S. Pat. No. 3,518,067). In addition, it has been recommended that the surface be swelled and softened with organic solvents such as aliphatic alcohols and ketones including methanol, ethanol, acetone, and methyl ethyl ketone (U.S. Pat. Nos. 3,533,828; 3,574,070).

Another approach to activating dielectric surfaces is to treat the article with a silver salt dissolved in an evaporable organic solvent. The salt is then reduced to electro-conductive silver by immersion in an alkaline reducing bath of NaOH, formalin and water. A solution of silver perchlorate in benzene or toluene has been used as the source of silver (U.S. Pat. No. 2,511,472).

SUMMARY OF INVENTION

In accordance with the present invention there is provided a method of plating the surface of a substrate comprising the steps of coating said substrate with a silver-pyridine complex in an organic solvent; converting the complex to silver oxide and reducing the silver oxide to metallic silver. The metallic silver layer can then catalyze the deposition thereon of a metal from an electroless plating solution.

When the substrate is copper, surprisingly, a continuous and reflective metallic silver layer is formed spontaneously after coating such substrate with the silver-pyridine complex, drying it and then immersing it in a basic solution. Hence, the step of reducing a silver oxide to metallic silver is not needed.

DETAILED DESCRIPTION

Figure 1:
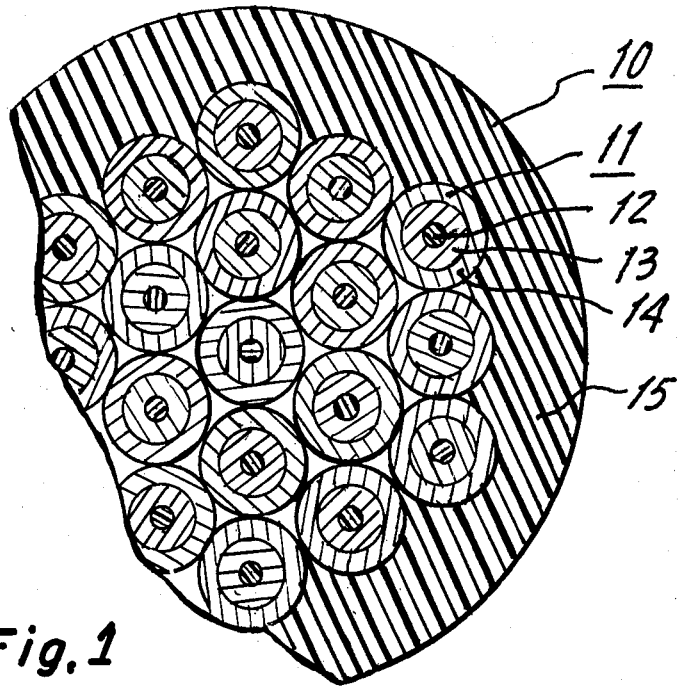
FIG. 1 is a partial cross-sectional view of an insulated conductor made in accordance with the method of the present invention.

In accordance with the invention, a substrate is coated with a silver-pyridine complex dissolved in a non-aqueous solvent which preferably also swells and softens the substrate surface to increase the adhesion of the complex onto the surface. The substrate may be in the form of a filament, film, sheet, plate, textile fiber or fiber bundle and can be of inorganic or organic composition. Suitable organic substrates include acrylics, polyamides and vinyls such as methacrylate, nylon and polyvinyl chloride, respectively. Thus far, unsatisfactory plating has resulted when the substrate is a polyester yarn or monofilament. Suitable organic solvents include low molecular weight ketones and alcohols and mixtures thereof. Preferably, the molecular weight range is about 50 to 184 and about 30 to 100, respectively. An especially suitable solvent combination is that of an alkyl ketone having from 3–6 carbon atoms with a primary or secondary alcohol having from 1–3 carbon atoms.

After coating the substrate with the complex, the excess solvent is evaporated from the substrate.

Thereafter, the substrate is treated with a preferably non-aqueous basic solution which results in the conversion of the complex to silver oxide. Preferably, the base is NaOH or KOH. The solvent for the base is preferably an alcohol having 1–3 carbon atoms including ethyl alcohol, methanol, propanol and a mixture of these.

The treated substrate is washed with water and the silver oxide adhering to the substrate surface is then reduced to metallic silver by either heating, direct chemical reduction, as for example, by hydrazine reduction, or by exposing the surface to a gaseous reducing atmosphere, such as CO, $H_2$ and a mixture thereof.

The silver layer that results can catalyze the deposition of a continuous adherent electrically conductive layer of metal by conventional electroless plating.

When the substrate is copper, the rection is unexpectedly somewhat different. Instead of the silver-pyridine complex being converted to silver oxide upon treatment with the basic solution it is spontaneously converted to a continuous and reflective layer of metallic silver. Therefore, the separate step of reduction is eliminated, and the treated substrate is ready for electroless plating. This result was surprising since there was no indication that copper would react any differently with the silver-pyridine complex than any other substrate.

The process disclosed in the present invention can, amongst other things, be used to make a conductor and such process will be further described in this context.

A continuous non-twisted dielectric fiber bundle consisting of 140 filaments of 840 denier nylon yarn is used as the substrate material. However, any nylon cord, twisted or untwisted, multifilament or monofilament can be used.

In carrying out the invention, it is advantageous to continuously pull the length of yarn through a sequential series of tanks and ovens.

The first tank is operated at a reflux temperature of about 64° C. and the nylon residence time in the tank is about 20 seconds. The tank contains a solution of silver-pyridine complex dissolved in an organic solvent which is prepared by dissolving 12–15 g. of crystalline silver nitrate in 15 ml pyridine while heating continuously to 185°–190° C. It should be noted that in preparing the complex, the concentration of the silver salt can range from very low to saturated and still be effective. When the color takes on a gray-black tint, the mixture is cooled and 120 ml of methanol is added. If a white flocculent precipitate forms, the solution should be reheated. The final solution has an acidic pH and a clear orange-yellow color. A small amount of fine black precipitate may also be present. This precipitate may be filtered out, if desired.

After the yarn is pulled through the first tank, it is preferably completely dried in a forced air oven for about 5 to 10 minutes. The effect of temperature on the success of subsequent steps when using multifilament nylon yarn is important. Increased temperatures enhance retention of silver on the nylon surface but interfere with oxide formation in the subsequent treatment with potassium hydroxide. In addition, temperatures above 120° C. cause the filaments of nylon yarn to adhere to each other. Conequently, in practice, oven temperatures between 102° to 114° C. are used. This range represents a compromise between excessive wash of which occurs at reduced temperatures and the adverse effect of adhesion and incomplete oxide formation at higher temperatures. Higher temperatures are probably more advantageous when using substrates having higher melting temperatures.

After the yarn is dried, it is pulled into a 0.05 to 0.8 molar solution of KOH comprising by volume, 90% ethanol, 5% methanol and 5% 2-propanol as solvent maintained at its reflux temperature of about 75° C., for a residence time in this solution of about 5 minutes. In this basic solution the silver-pyridine complex is converted to silver oxide. The yarn is then rinsed in water for about 30 seconds. The silver oxide on the surface of each fiber of the yarn is then reduced to catalytically active metallic silver by heating to 165° to 170° C. for about 10 minutes.

The catalyzed yarn is then exposed to a conventional electroless plating environment, such as commercially available Shipley CP74, copper plating solution wherein the silver initiates the deposition of a continuous layer of copper on the fibers of the yarn. A minimum effective plate thickness, calculated from weight per length of yarn, is 5 to 10 microinches.

A second layer of copper is deposited by conventional electroplating techniques such as electroplating with Technits, Inc., Technicopper P-17, copper electroplating bath, a copper pyrophosphate bath without $H_2SO_4$. First a lwo current density and then a higher current density is applied until the copper so deposited has a final conductivity of about 0.42 ohms per ft. Usually an electroplated copper layer of about 20 to 50 microinches is sufficient.

After electroplating, the metallized fibers are twisted. A uniform twist of from three to five turns per inch gives a stable round configuration and minimizes variation in resistance under flexion and tension.

The twisted fibers are coated with an insulating material such as a thermoplastic polyester, for example, Hytrel, by DuPont to form an insulated conductor.

FIG. 1 represents a partial cross-sectional view of an insulated conductor formed by the above process. The conductor 10 includes a plurality, e.g. 140, of twisted conductive elements 11. Each conductive element 11 includes one of the fibers 12 of a fiber bundle, each fiber having a first layer 13 of electrolessly plated copper and a second layer 14 of electroplated copper overlying the electrolessly plated layer 13. A jacket of thermoplastic polyester 15 surrounds the twisted conductive elements 11. The silver layer used to catalyze the electroless copper deposit is not shown.

Figure 2:
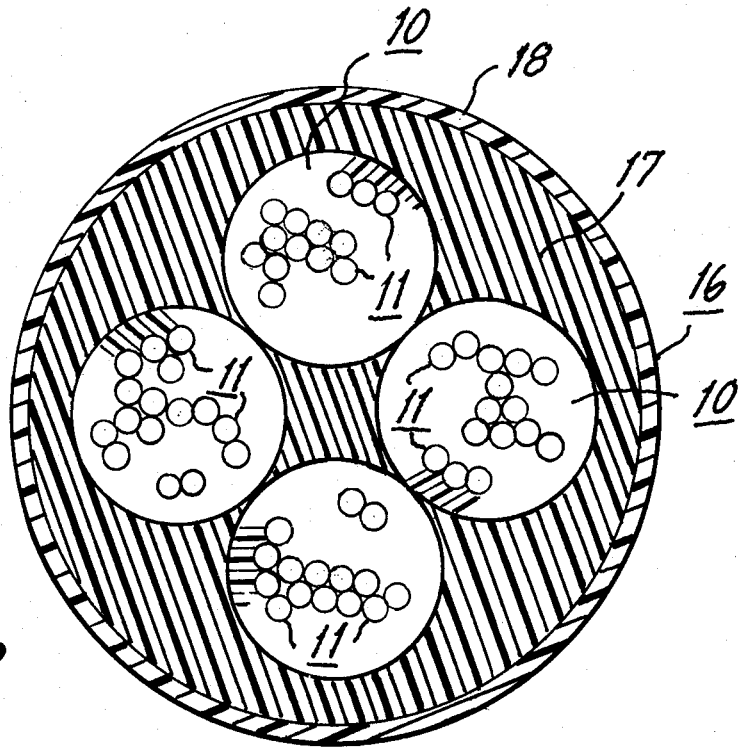
FIG. 2 is a partial cross-sectional view of a cord made in accordance with the method of the present invention.

As shown in FIG. 2, a cord 16 may then be formed by twisting and jacketing a plurality, e.g., four, of the insulated conductors made in the above process. More specifically the insulated conductors 10 are jacketed with a vinyl polymer jacket 17 and topcoated with a polyester resin 18. A preferred polymer for jacketing is PVC, in particular, of a composition comprising a solid halide polymer, an ethylene terpolymer and an alkyl acrylate copolymer as described in U.S. Pat. No. 4,123,585; the disclosure of which is incorporated herein by reference.

It is understood that the above-described embodiment is simply illustrative of the principles of the invention. Various changes and modifications may be made by those skilled in the art without departing from the scope and spirit of this invention as defined in the appended claims. For example, the invention may be used in forming electrostatic shields for conventional cords and cables. Typically, such a shielded cord comprises a center conductor having a plastic insulating layer therearound and the electrostatic shield formed on the surface of the insulating layer by the method of this invention. An insulating jacket is provided over the electrostatic shield. Additionally, although the invention has been illustrated as being used in the manufacture of a round cord, it is to be understood, that the invention may be used to manufacture a flat cord of the type shown in U.S. Pat. No. 4,166,881, the disclosure of which is incorporated herein by reference.

What is claimed is:

1. A method of plating a dielectric surface of a substrate comprising the steps of:

(a) coating the substrate with a solution comprising a silver-pyridine complex dissolved in a non-aqueous solvent;

(b) drying the substrate;

(c) immersing the substrate in a basic solution whereby the silver-pyridine complex is converted to a silver oxide; and (d) reducing the silver oxide to metallic silver.

2. The method recited in claim 1 wherein the non-aqueous solvent comprises a member of the group consisting of a low molecular weight ketone, a low molecular weight alcohol and a mixture thereof.

3. The method recited in claim 2 wherein the ketone is an alkyl ketone having from 3–6 carbon atoms and the alcohol is selected from the group consisting of a primary alcohol and a secondary alcohol having from 1–3 carbon atoms.

4. The method recited in claim 2 wherein the solvent comprises a member of the group consisting of (1) a mixture of methyl ehtyl ketone with isopropanol and (2) methanol.

5. The method recited in claim 1 wherein said silver-pyridine complex is formed by dissolving a silver salt in pyridine.

6. The method recited in claim 5 wherein said silver salt is silver nitrate.

7. The method recited in claim 1 wherein the substrate is an organic polymer.

8. The method recited in claim 7 wherein the substrate is a polymer selected from the group consisting of polyamides and vinyls.

9. The method recited in claim 8 wherein the substrate is selected from the group consisting of nylon and polyvinyl chloride.

10. The method recited in claim 1 wherein said basic solution is non-aqueous and is an alkaline metal hydroxide in an alcohol solvent having from 1–3 carbon atoms.

11. The method recited in claim 10 wherein the alkaline metal hydroxide is selected from NaOH and KOH and the alcohol comprises a member of the group consisting of ethyl alcohol, methanol, propanol, isopropanol, and a mixture of the foregoing alcohols.

12. The method recited in claim 1 wherein the silver oxide is reduced to metallic silver by heating at a temperature greater than 100° C. but less than the temperature at which the substrate melts or decomposes.

13. The method recited in claim 1 wherein the silver oxide is reduced by treating with a chemical reducing agent.

14. The method as recited in claim 13 wherein the chemical reducing agent is hydrazine.

15. The method as recited in claim 13 wherein the chemical reducing agent comprises a reducing gas selected from the group consisting of CO, $H_2$ and a mixture thereof.

16. The method as recited in claim 1 wherein the substrate is a continuous, non-twisted, fiber bundle.

17. The method as recited in claim 16 wherein the drying temperature is lower than the temperature at which the fibers adhere to each other.

18. The method recited in claim 1 wherein the substrate comprises a nylon textile yarn.

19. The method recited in claim 18 wherein the substrate is dried at a temperature between 104° to 115° C.

20. The method recited in claim 19 wherein said silver oxide is reduced to metallic silver by heating.

21. A method of spontaneously plating a continuous, reflective layer of silver on a substrate comprising the steps of:

(a) coating the substrate with a solution comprising a silver-pyridine complex dissolved in a non-aqueous solvent;

(b) drying the substrate; and (c) immersing the substrate in a basic solution, whereby the silver-pyridine complex is directly converted to a continuous reflective silver layer.

22. A method as recited in claim 21 wherein said substrate is copper.

23. The method recited in claims 1 or 21 including the step of subjecting the metallic silver layered substrate to electroless plating.

24. The method recited in claim 23 including the step of electroplating a metal onto the substrate.

25. A method of making an insulated conductor comprising the steps of;

(a) immersing a substrate, selected from the group consisting of a continuous, dielectric fiber bundle, in a solution comprising a silver-pyridine complex dissolved in a non-aqueous solent;

(b) drying the fiber bundle;

(c) immersing the fiber bundle in a basic solution whereby the silver-pyridine complex is converted to a silver oxide;

(d) reducing the silver oxide to metallic silver;

(e) electroless plating the fiber bundle;

(f) electroplating the fiber bundle; and (g) insulting the fiber bundle.

26. The method recited in claim 25 wherein the substrate consists of a continuous non-twisted dielectric fiber bundle and including the step of twisting the fiber bundle subsequent to electroplating and prior to insulating.

27. The method recited in claim 25 wherein the fiber bundle is an organic polymer.

28. The method recited in claim 25 wherein the polymer is selected from the group consisting of polyamides and vinyls.

29. The method recited in claim 25 wherein the polymer is selected from the group consisting of nylon and polyvinyl chloride.

30. A method of making an insulated conductor comprising the steps of:

(a) coating a continuous length of non-twisted nylon yarn with a solution comprising a silver-pyridine complex dissolved inl a non-aqueous solvent, (b) drying the yarn at between 102° to 114° C., (c) converting the silver-pyridine complex to silver oxide by treating with a basic solution, (d) reducing the silver oxide to metallic silver by heating at a temperature from about 165° to 170° C., (e) electroless plating the yarn with a conductive metal, (f) electroplating the yarn with a conductive metal, (g) twisting the plated yarn, and (h) insulating the twisted yarn.

31. The method recited in claims 25 or 30 wherein a plurality of insulated conductors are twisted, and a polymer jacket is formed over the plurality of insulated conductors to form a conductive cord.

* * * * *

UNITED STATES PATENT AND TRADEMARK OFFICE

CERTIFICATE OF CORRECTION

PATENT NO. : 4,241,105

DATED : December 23, 1980

INVENTOR(S) : W. T. MAYWEATHER

It is certified that error appears in the above—identified patent and that said Letters Patent is hereby corrected as shown below:

In the specification, Column 1, line 36, "fo" should read --for--. Column 2, line 59, "rection" should read --reaction--. Column 3, line 39, "wash of" should read --wash off--. Column 3, line 67, "lwo" should read --low--.

In the claims, column 6, claim 25, line 12, "of;" should read --of:--; lines 13 and 14, "substrate, selected from the group consisting" should read --substrate consisting--; line 16, "solent;" should read --solvent;--; line 24, "insulting" should read --insulating--; claim 28, line 32, "25" should read --27--; claim 29, line 35, "25" should read --27--; claim 30, line 42, "inl" should read --in--.

Signed and Sealed this

*Fifth* Day of *May 1981*

[SEAL]

*Attest:*

RENE D. TEGTMEYER

*Attesting Officer* *Acting Commissioner of Patents and Trademarks*